United States Patent [19]

Green

[11] 4,070,334

[45] Jan. 24, 1978

[54] METHOD OF BONDING

[75] Inventor: George Edward Green, Cambridge, England

[73] Assignee: Ciba-Geigy Corporation, Ardsley, N.Y.

[21] Appl. No.: 636,893

[22] Filed: Dec. 2, 1975

[30] Foreign Application Priority Data

Dec. 11, 1974 United Kingdom ..... 53677/74

[51] Int. Cl.[2] ..... C08J 3/24

[52] U.S. Cl. ..... 260/42.53; 164/12; 260/42.55; 260/DIG. 41; 526/208; 526/217

[58] Field of Search ..... 260/42.53, 42.55, DIG. 41; 526/217, 208

[56] References Cited

U.S. PATENT DOCUMENTS

| | | | |
|---|---|---|---|
| 3,043,820 | 7/1962 | Krieble | 526/208 |
| 3,121,268 | 2/1964 | Ruhens | 260/42.53 X |
| 3,145,438 | 8/1964 | Kottke et al. | 260/42.53 X |
| 3,218,305 | 11/1965 | Krieble | 526/217 X |
| 3,652,521 | 3/1972 | Aherd | 526/217 X |
| 3,775,385 | 11/1973 | Ozono et al. | 526/217 X |
| 3,970,505 | 7/1976 | Hauser et al. | 526/217 |

FOREIGN PATENT DOCUMENTS 1,132,821 11/1968 United Kingdom.

OTHER PUBLICATIONS

Irving Skeist, ed., *Handbook of Adhesives* (1962), p. 340.

*Primary Examiner*—Sandra M. Person
*Attorney, Agent, or Firm*—Vincent J. Cavalieri

[57] ABSTRACT

A method of making a shaped article from particulate solid material, such as a foundry mould or core from sand, comprises i. forming a mixture of the particles and an anaerobically-curing adhesive containing, as a curing accelerator, either an aliphatic amine having at least two primary aliphatic amino groups or a condensation product of such an amine with a ketone or with an aldehyde, ii. forming the mixture into the desired shape, and iii. in the presence of water, causing the adhesive to cure and to bond the particles together by displacing air or other oxygen-containing gas in the environment of the shaped article with an inert gas or vapor.

25 Claims, No Drawings

METHOD OF BONDING

DETAILED DISCLOSURE

This invention relates to a method of bonding together solid particulate materials to form shaped articles and to shaped articles formed by that method. It is especially applicable to the binding of refractory particulate material for making foundry cores and moulds and the invention will be described with especial reference to making such cores and moulds. However, the method is also useful in making other kinds of shaped articles from particulate materials, including exothermically-reacting compositions, for example.

In the production of foundry moulds and cores, sand or other refractory particulate material is bonded together by means such as the deposition of a silica hydrogel, achieved by coating the particles with aqueous sodium silicate and moulding them to the desired shape, then treating with carbon dioxide or other acid gas and allowing the mixture to harden in its moulded shape. Other methods which have been used involve coating the particles with a curable synthetic resin composition, such as a urea-formaldehyde resin composition, and curing the composition.

A disadvantage of methods hitherto available is that the development of a cohesive strength sufficient for the cores to be handled under foundry conditions usually takes several hours, sometimes twelve or more: currently, the foundry industry seeks, for more economical working, methods which will provide cores attaining adequate cohesive strength within at most one hour yet which employ only low proportions of bonding agent.

In Belgian Patent Specification No. 813,644 it was disclosed that these requirements could be at least substantially met by the use of anaerobically-curing adhesives. These adhesives, which usually contain acrylate ester monomers, are stable on storage in air or other oxygen-containing gas but, in the presence of a catalyst, they polymerise when the oxygen is excluded. The reason usually advanced for this behaviour is that radicals continuously generated in the adhesive composition react with the oxygen while this is available; when, however, oxygen is excluded, the radicals induce polymerisation of the monomer.

The method described in the aforesaid Belgian Patent comprises i. forming a mixture of the particles and an anaerobically-curing adhesive and moulding the mixture to the desired shape, and ii. causing the adhesive to cure and bond the particles together by maintaining the shaped article in a substantially oxygen-free environment.

Preferably the substantially oxygen-free environment was attained by displacing air or other oxygen-containing gas by a gas or vapour which did not inhibit curing of the anaerobic adhesive, nitrogen being particularly suitable. Preferably, too, the shaped object was maintained in a substantially oxygen-free environment for a minimum of 10 minutes so that curing had advanced substantially before air could seep back into the interstices of the shaped object and so inhibit further curing.

However, the foundry industry continues to set more demanding requirements in the way of speedier production, and so the need exists for means to cause the shaped object to acquire sufficient compressive strength in even shorter periods and to dispense with the storage in a substantially oxygen-free environment.

In the process described in the Belgian patent, nitrogen or carbon dioxide was used, from cylinders as received, to displace the air. The nitrogen and the carbon dioxide employed contained, respectively, less than one part and less than ten parts per million by weight of water vapour, i.e., less than 0.00125 and 0.0196 grams respectively per cubic metre.

It has now been surprisingly found that, by using a gas which has been made wetter, such as by passage through water, or by using an anaerobically-curing adhesive which contains a small amount of water, the aforesaid more stringent requirements can at least substantially be met.

The increased rate of bonding is obtained in the presence of certain types of substance, some of which were described as accelerators in the above-mentioned Belgian patent; however, the enhanced rate is obtained only when additional water is present.

This invention accordingly provides a method of making a shaped article from particulate solid material which comprises i. forming a mixture of the particles and an anaerobically-curing adhesive containing, as a curing accelerator, an aliphatic amine having at least two primary aliphatic amino groups or a condensation product of such an amine with a ketone or an aldehyde, ii. forming the mixture into the desired shape, and iii. in the presence of water, causing the adhesive to cure and to bond the particles together by displacing air or other oxygen-containing gas in the environment of the shaped article with an inert gas or vapour.

By "inert" we mean those gases or vapours which do not inhibit curing of the adhesive.

The inert gas or vapour is preferably nitrogen but the rare gases such as helium may be employed: carbon dioxide may also be used but in this case curing does not take place quite so rapidly as when nitrogen or a rare gas is used.

Obviously, the amount of water present must not be so excessive as to prevent effective binding together of the particles by the adhesive. The amount of water is greater than that which the gas or vapour and the particles normally contain under the conditions of temperature and pressure which are employed but preferably it is at most 0.5%, and particularly at most 0.1%, by weight, calculated on the combined weight of the adhesive and the particles.

The inert gas or vapour is usually employed at room temperature or somewhat above, say at from 15° to 35° C; a sufficient amount of water is conveniently imparted to the shaped article by first passing the inert gas or vapour through water e.g., in that temperature range. Typically, the so moistened inert gas or vapour contains from 5 to b 40 grams and especially 10 to 30 grams of water vapour per cubic meter.

The preferred anaerobic adhesives comprise, in addition to the curing accelerator, a. an ester of an acrylic acid, and b. a latent initiator of free-radical polymerisation, such as a diazonium salt, and preferably a redox-activatable initiator such as a hydroperoxide or peroxide.

Suitable esters of acrylic acids include those of the general formula

I

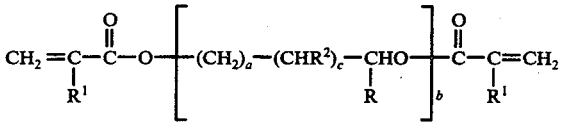

where a is an integer of 1 to 8, b is an integer of 1 to 20, c is zero or 1,

R denotes —H, $—CH_3$, $—C_2H_5$, $—CH_2OH$, or

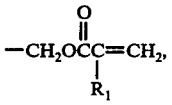

each $R^1$ denotes —H, —Cl, $—CH_3$, or —Chd $2H_5$, and $R^2$ denotes —H, —OH, or

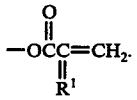

Preferred among such compounds are those of formula I where *a* is 1, *b* is from 2 to 5, *c* is zero, and R and $R^1$ each denote —H or $—CH_3$.

Compounds of the formula I are described in United Kingdom Patent Specification No. 824,677. Specific examples of such compounds are triethylene glycol dimethacrylate and tetraethylene glycol diacrylate and dimethacrylate (respectively, Product "C," "H," and "I" below).

Other suitable esters are of the general formula

II

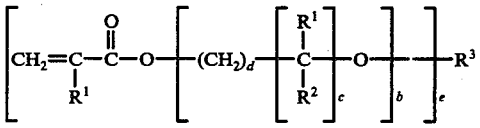

where

*b, c,* $R^1$, and $R^2$ have the meanings assigned above,

*d* is zero or a positive integer, provided that *c* and *d* are not both zero,

*e* is 1, 2, 3, or 4, and $R^3$ denotes an organic radical or valency *e* linked through a carbon atom or carbon atoms thereof to the indicated *e*-terminal oxygen atoms.

Preferred among such compounds are those where, in formula II, *b, c,* and *d* are each 1, $R^1$ is —H or $—CH_3$, and $R^3$ is the hydrocarbon residue of an aliphatic alcohol containing from 1 to 6 carbon atoms, such as $—CH_3$ or

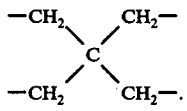

Compounds of formula II are described in United Kingdom Patent Specification No. 1,228,479.

Yet other suitable esters are those of the formula

III

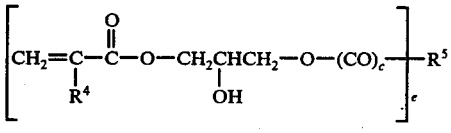

where

*c* and *e* have the meanings previously assigned, $R^4$ denotes —H or $—CH_3$, and $R^5$ denotes an organic radical of valency *e,* linked through a carbon atom thereof other than the carbon atom of a carbonyl group.

More particularly, when *c* is zero, $R^5$ may denote the residue, containing from 1 to 18 carbon atoms, of an alcohol or phenol having *e* hyroxyl groups.

$R^5$ may thus represent an aromatic group (which may be substituted in the ring by alkyl groups), an araliphatic, cycloaliphatic, heterocyclic, or heterocycloaliphatic group, such as an aromatic group containing only one benzene ring, optionally substituted by chlorine or by alkyl groups each of from 1 to 9 carbon atoms, or an aromatic group comprising a chain of two benzene rings, optionally interrupted by ether oxygen atoms, alipahtic hydrocarbon groups of 1 to 4 carbon atoms, or sulphone groups, each benzene ring being optionally substituted by chlorine or by alkyl groups each of from 1 to 6 carbon atoms, or, preferably, a saturated or unsaturated, straight or branched-chain aliphatic group, which may contain ether oxygen linkages and which may be substituted by hydroxyl groups, especially a saturated or monoethylenically-unsaturated straight chain aliphatic hydrocarbon group of from 1 to 8 carbon atoms.

Specific examples of such groups are the aromatic groups of the formulae $—C_6H_5$ and $—C_6H_4CH_3$, in which case *e* is 1,

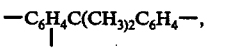

and $—C_6H_4CH_2C_6H_4—$, in which case *e* is 2, and $—C_6H_4\,(CH_2C_6H_3)_f—CH_2C_6H_4$ —where *f* is 1 or 2, in which case *e* is 3 or 4, and the aliphatic groups of formula

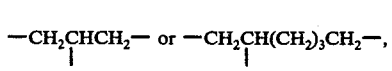

in which case *e* is 3, of formula $—(CH_2)_4—$, $—CH_2CH{=}CHCH_2—$, $—CH_2CH_2OCH_2CH_2—$, or $—(CH_2CH_2O)_2CH_2CH_2—$, in which case *e* is 2, or of th forula $—(CH_2)_3CH_3$, $—(CH_2)_4OH$, $—CH_2CH{=}CH_2$, or $—CH_2CH{=}CHCH_2OH$, in which case *e* is 1.

When *c* is 1, $R^5$ may represent the residue, containing from 1 to 60 carbon atoms, of an acid having *e* carboxyl groups, preferably a saturated or ethylenically-unsaturated, straight chain or branched aliphatic hydrocarbon group of from 1 to 20 carbon atoms, which may be substituted by chlorine atoms and which may be interrupted by ether oxygen atoms and/or by carbonyloxy (—COO—) groups, or a saturated or ethylenically-unsaturated cycloaliphatic or aliphatic-cycloaliphatic hydrocarbon group of at least 4 carbon atoms, which may be substituted by chlorine atoms, or an aromatic hydrocarbon group of from 6 to 12 carbon atoms, which may be substituted by chlorine atoms.

Further preferred are such compounds in which $R^5$ represents a saturated or ethylenically-unsaturated straight chain or branched aliphatic hydrocarbon group of from 1 to 8 carbon atoms, optionally substituted by a hydroxyl group, or a saturated or ethlenically-unsaturated straight chain or branched aliphatic hydrocarbon group of from 4 to 50 carbon atoms and interrupted in the chain by carbonyloxy (—COO—) groups, or a saturated or ethylenically-unsaturated monocyclic or dicyclic cycloaliphatic hydrocarbon group of 6 to 8 carbon atoms, or an ethylenically-unsaturated cycloaliphatic-aliphatic hydrocarbon group of from 10 to 51 carbon atoms, or a mononuclear aromatic hydrocarbon group of from 6 to 8 carbon atoms, Specific examples of these residues of caboxylic acids are those of the formula $—CH_3$, $—CH_2CH_3$, $—CH_2CH(OH)CH_3$, $—CH_2Cl$, and $—C_6H_5$, in which case *e* is 1, and $—CH_2CH_2—$, —CH=CH—, and $—C_6H_4—$, in which case *e* is 2.

Compounds of the general formula III are described in United Kingdom Patent Specifications Nos. 831,056, 977,361, 989,201, 1,006,587, 1,054,614, 1,146,474, 1,195,485, 1,222,369, 1,235,769, 1,241,851, 1,262,692, and 1,266,159, Canadian Patent Specifications Nos. 804,670 and 888,274, U.S. Pat. No. 3,221,043, and French Patent Specification No. 1,531,224, Specific examples of suitable compounds of formula III are 1,4-bis(2-hydroxy-3-(methacrylyloxy)propoxy)-butane ("Product A" below, a poly(2-hydroxy-3-(methacryloxy)propyl) ether of a phenolformaldehyde novolak (used in "Prudct D" below), 1-(2-hydroxy-3-methacrylyloxypropoxy)butane ("Product E" below), bis(2-hydroxy-3-methacrylyloxypropyl) adipate ("Product F" below), and 2-hydroxy-3-methacrylyloxypropyl propionate ("Product G" below).

Still other suitable esters are acrylate-urethanes and acrylateureides of the general formula

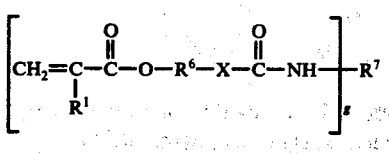

IV where $R^1$ has the meaning assigned above, $R^6$ denotes a divalent aliphatic, cycloaliphatic, aromatic, or araliphatic group, bound through a carbon atom or cabon atoms thereof to the indicated —O— atom and —X— atom or group, X denotes—O— or $—N(R^8)—$, where $R^8$ stands for —H— or an alkyl radical of from 1 to 8 carbon atoms,

*g* is an integer of at least 2 and at most 6, and $R^7$ denotes a *g*-valent cycloaliphatic, aromatic, or araliphatic group bound through carbon atom or carbon atoms thereof to the indicated NH groups.

Preferably $R^6$ denotes a divalent aliphatic group of 2 to 6 carbon atoms and $R^7$ denotes one of the following:

a divalent aliphatic group 2 to 10 carbon atoms, such as a group of formula $—(CH_2)_6—$, $—CH_2C(CH_3)_2CH_2CH(CH_3)(CH_2)_2—$, or $—CH_2CH(CH_3)CH_2C(CH_3)_2(CH_2)_2—$; or a phenylene group, optionally substituted by a methyl group or a chlorine atom;

a naphthalene group;

a group of formula $—C_6H_4C_6H_4—$, $—C_6H_4CH_2C_6H_4—$, or $—C_6H_4C(CH_3)_2C_6H_4—$;

or a mononuclear alkylcycloalkylene or alkylcycloalkylalkylene group of from 6 to 10 carbon atoms, such as a methylcyclohex-2,4-ylene, methylcyclohex-2,6-ylene, or 1,3,3-trimethylcyclohex-5-ylenemethyl group.

Compounds of the general formula IV are described in United Kingdom Patent Specification No. 1,132,821.

Specific exmples of compounds of formula IV are 2,4- and 2,6-bis(2-methacrylyloxyethoxycarbonamido)-toluene (see "Product J" below).

Yet other suitable esters are those of the general formula

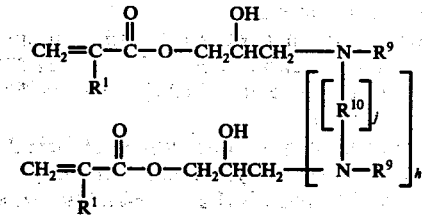

V where each $R^1$ has the meaning previously assigned, each $R^9$ denotes a hydrogen atom or an alkyl radical of 1 to 6 carbon atoms, optionally substituted by a cyano or hydroxyl group or by a group of formula

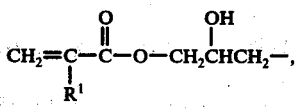

each $R^{10}$ is a divalent aliphatic, aromatic, heterocyclic or cycloaliphatic residue of 1 to 10 carbon atoms, linking through carbon atoms thereof the indicated nitrogen atoms,

*j* is 0 or 1, and

*h* is 0 or an integer of from 1 to 4, with the proviso that when *j* represents zero, *h* represents 1.

$R^9$ preferably denotes an isopropyl group.

$R^{10}$ preferably denotes an ethylene, propylene, or p-phenylene group.

A specific example of a compound of the general formula V is that of the formula

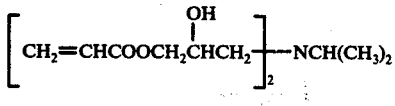

VI

Compounds of the general formula V are described in United Kingdom Patent Specification No. 1339017.

Still further esters are those of the general formula

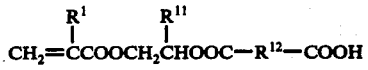

VII where $R^1$ has the meaning assigned above, $R^{11}$ denotes —H, —$CH_3$, or —$CH_2Cl$, and $R^{12}$ denotes the residue of an at least dicarboxylic acid after removal of two carboxyl groups, linked through one carbon atom to the indicated group

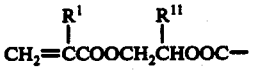

and by an adjacent carbon atom to the indicated —COOH group, and may, if containing one or more carbocyclic rings, be optionally substituted by both another —COOH group and another group

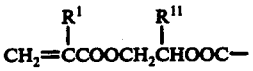

on adjacent carbon atoms.

Compounds of formula VII are described in Japanese published patent applications Nos. 121,886/74, 89,947/73, 88,126/73, and 9,4,60/73, and in French Patent No. 2,241,598.

A specific example of a monoacrylate of formula VII is 2-(methacryloxy)ethyl hydrogen phthalate.

Diacrylates of formula VII are preferably further of the formula

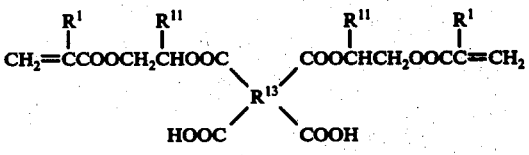

VIII where each $R^1$ and $R^{11}$ have the meanings assigned above, and $R^{13}$ denotes a tetravalent group containing one or more carbocyclic rings, each indicated pair of groups

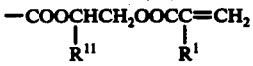

and —COOH being directly linked to adjacent carbon atoms.

Preferably $R^{13}$ represents a group of formula

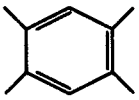

IX

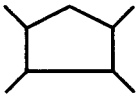

X

-continued

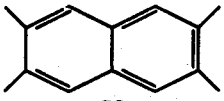

XI

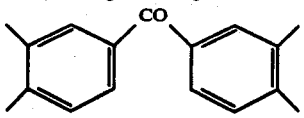

XII

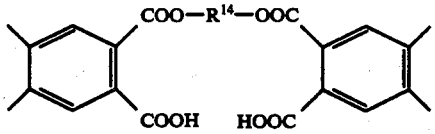

XIII

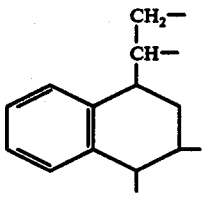

XIV or

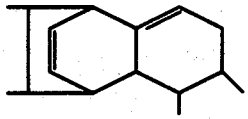

XV where $R^{14}$ is the residue of a glycol after removal of two alcoholic hydroxyl groups.

Compounds of formula VII are obtainable by reaction of an alcohol of formula

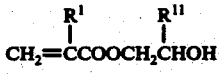

XVI such as 2-hydroxyethyl methacrylate with an anhydride of formula

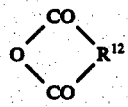

XVII such as phthalic anhydride or hexahydrophthalic anhydride or with a dianhydride of formula

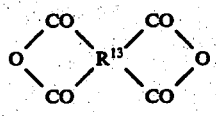

XVIII such as pyromellitic dianhydride or benzophenone-3,3',4,4'-tetracarboxylic acid dianhydride.

Other acrylates which may be used are those of the formula

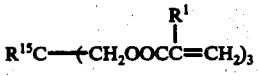

XIX where $R^1$ has the meaning previously assigned and $R^{15}$ is $CH_3$-, $C_2H_5$-, or $$-CH_2OOCC(R^1)=CH_2,$$

such as pentaerythrityl tetramethacrylate and 1,1,1-trimethylolpropane trimethacrylate ("Product B" below). Compounds of formula XIX are described in e.g., German Offenlegungsschrift 2,132,881, and are commercially available.

Amines suitable as accelerators include alkylenediamines and polyalkylene polyamines of the formula $$H_2N(CH_2CH(R^4)NH)_kH \qquad XX$$

where $R^4$ has the meaning previously assigned and $k$ is an integer of 1 to 4.

Other suitable amines are higher $\alpha,\omega$-diprimary amino alkanes such as 1,4-diaminobutane, 1,5-diaminopentane, 1,6-diaminohexane, 1,6-diamino-2,2,4-trimethylhexane, and 1,6-diamino-2,4,4-trimethylhexane.

Preferably, however, the accelerator is a condensation product as aforesaid, especially one free from primary amino groups, since such products are more pleasant to handle under industrial conditions and formulations containing them have a longer pot-life, and preferably they are such condensation products of the amines of formula XX.

To prepare these condensation products the amine may be heated with an excess of the ketone or aldehyde, if desired in an inert atmosphere such as nitrogen, and the water liberated and the excess of the ketone or aldehyde are removed by distillation. When the ketone or aldehyde boils at a higher temperature than does water and is not completely removed by azeotropic distillation with water, it is preferable to distil off the residual ketone or aldehyde under reduced pressure after removal of the water is complete.

The ketone and aldehyde do not contain groups, other than keto or aldehyde groups, capable of reaction with the amine under the conditions employed to form the accelerator. Preferably they contain only carbon and hydrogen atoms and oxygen only in the form of keto or aldehyde groups.

It is believed—although the utility of this invention does not depend on the truth of this belief—that the condensation products, used as accelerators, formed from an aliphatic polyamine and a ketone or an aldehyde are generally ketimines and aldimines, but in one case (Accelerator C below, formed from acetone and triethylenetetramine) NMR spectra studies indicated that the accelerator was not the expected diketimine.

The ketone is preferably aliphatic, and of three to ten carbon atoms, such as acetone, isobutyl methyl ketone, ethyl methyl ketone, and di-isobutyl ketone. The aldehyde is also preferably aliphatic, and of two to six carbon atoms, such as n- or iso-butyraldehyde.

Organic hydroperoxides are preferably used as the latent initiator, such as those of formula $R^{16}OOH$, where $R^{16}$ is a monovalent organic radical containing up to 18 carbon atoms, especially an alkyl, aryl, or aralkyl radical containing from 4 to 13 carbon atoms. Typical hydroperoxides are ethyl methyl ketone hydroperoxide, tert.butyl hydroperoxide, cumene hydroperoxide, and hydroperoxides formed by the oxygenation of cetene or cyclohexene, tert.butyl hydroperoxide and cumene hydroperoxide being especially effective. Hydrogen peroxide may also be employed. A range of organic peroxides may be used, such as 2,5-dimethyl-2,5-di(tert.butylperoxy)hexane, di-tert.butyl peroxide, dihexylene glycol peroxide, tert.butyl cumyl peroxide, isobutyl methyl ketone peroxide, and also peresters such as tert.butyl perbenzoate, tert.butyl peracetate and tert.butyl perphthalate.

Diazonium salts useful as initiators are listed in U.S. Pat. No. 3,880,956, a specific example being bis(4-(N,N-diethylamino)benzenediazonium) tetrachlorozincate.

The amount of the latent initiator (b) may, for example, vary between 0.01% and 15% by weight of the ester (a); quantities of from 1% to 10% by weight are, however, more frequently used. The amount of the accelerator used is preferably also from 1 to 10% by weight of the ester (a).

Often the rate of polymerisation can be further enhanced by including a monocarboxylic acid, especially alkanoic and alkenoic acids which are liquid at the temperatures employed, such as n-heptanoic and methacrylic acids. Usually, from 1 to 10% of the monocarboxylic acid, calculated on the combined weight of the acrylate ester, the latent initiator, and the accelerator, is employed.

The anaerobic adhesive may also contain various additives, such as inhibitors to prevent premature polymerisation, diluents, and thickeners. Typical inhibitors are quinones or hydroquinones: they may be employed in quantities of 0.001 to 0.1% by weight of the ester (a). It is generally desirable that the anaerobic adhesive is a liquid of low viscosity and it may be useful to add a diluent to lower the viscosity.

Anaerobic adhesives are, in the absence of the accelerator, stable for prolonged periods in the absence of a sufficient quantity of oxygen but cure when oxygen is excluded. They are therefore best stored in containers which have an adequate air space therein and/or are permeable to air.

The proportion of anaerobic adhesive to particulate material is usually from 0.5 to 10%, and especially 1 to 5%, by weight; larger amounts may be used but may prove uneconomical: the proportions are, of course, chosen so that the shaped article is permeable, for displacement of the oxygen-containing gas.

The anaerobic adhesive may be mixed with the particulate material by any known method. If desired, where the anaerobic adhesive comprises two interacting substances, such as components (a) and (b) above, the particulate material may be divided into two portions, the first of which is coated with component (a) and the second with component (b). The accelerator may be mixed with either portion. Coating may be carried out by, for example, using a laboratory mixer, by tumbling in a rotating drum, by spraying, or by dipping. The coated portions are stored separately until required, at which time they are brought into intimate contact and curing is caused to proceed. When the particulate material is a foundry refractory material it is particularly convenient to use an apparatus for mixing and discharging the sand directly into core boxes, such as that described in United Kingdom Specification No. 1,133,255.

The following Examples illustrate the invention: temperatures are in degrees Celsius.

The acrylates were made as described below. Epoxide contents were measured by titrating against a 0.1 N solution of perchloric acid in acetic acid in the presence of excess of tetraethylammonium bromide, crystal violet being used as the indicator.

PRODUCT A

This is substantially 1,4-bis(2-hydroxy-3-methacrylyloxypropoxy)-butane, which was prepared by adding, to a stirred mixture of methacrylic acid (67 g), triethylamine (1g), and hydroquinone (0.1 g) heated at 120° in a flask fitted with a reflux condenser, 100 g of butane-1,4-diol diglycidyl ether (epoxide content 7.8 equiv./kg) over 1 hour and stirring the mixture at 120° for 1 hour longer, by which time its epoxide content was zero.

PRODUCT B is 1,1,1-trimethylolpropane trimethacrylate.

PRODUCT C is a commercial quality of triethylene glycol dimethacrylate.

PRODUCT D

To a mixture of methacrylic acid (61 g), hydroquinone (0.3 g), and tetramethylammonium chloride (0.5 g), stirred at 120°, was added over 1 hour a mixture of 84 g of butane-1,4-diol diglycidyl ether (epoxide content 7.4 equiv./kg) and 16 g of an epoxy novolak resin (having an epoxide content of 5.48 equiv./kg and being a polyglycidyl ether of a phenol-formaldehyde novolak which had a number average molecular weight of 420). The mixture was stirred at 120° for 1 hour further, at which time the epoxide content was negligible. Product D comprises a mixture of Product A and a poly(2-hydroxy-3-methacrylyloxypropyl) ether of a phenol-formaldehyde novolak containing on average 4.07 2-hydroxy-3-methacrylyloxypropyl groups per molecule.

PRODUCT E

This is substantially 1-(2-hydroxy-3-methacrylyloxypropoxy)butane, which was prepared in a similar manner from 60.6 g of methacrylic acid and 100 g of n-butyl glycidyl ether (epoxide content 7.05 equiv./kg) in the presence of 2 g of triethylamine and 0.1 g of hydroquinone.

PRODUCT F

A mixture of adipic acid (30 g), glycidyl methacrylate (58.2 g), triethylamine (1 g), and hydroquinone(0.1 g) was heated at 120° for 2½ hours with stirring in a flask fitted with a reflux condenser. At this time the epoxide content of the product was zero.

Product F is substantially bis(2-hydroxy-3-methacrylyloxypropyl) adipate.

PRODUCT G

This is substantially 2-hydroxy-3-methacrylyloxypropyl propionate (glycerol methacrylate propionate), which was prepared by heating at 120° a stirred mixture of glycidyl methacrylate (50 g), propionic acid (26 g), triethylamine (0.7 g), and hydroquinone (0.07 g) for 2.5 hours, by which time the epoxide content of the mixture was zero.

PRODUCT H is tetraethylene glycol diacrylate.

PRODUCT I is tetraethylene glycol dimethacrylate.

PRODUCT J

To 87 g of toluene di-isocyanate (a mixture of the 2,4- and 2,6-isomers) was added with stirring 65 g of 2-hydroxyethyl methacrylate. An exothermic reaction set in and the temperature was allowed to rise to 90° within 10 minutes. Then a further 66 g of 2-hydroxyethyl methacrylate was added over 30 minutes without any heating. Hydroquinone (0.2 g) was added and the mixture was then stirred at 100° for 1 hour.

Product J is a mixture of 2,4- and 2,6-bis(2-methacrylyloxyethoxycarbonamido)toluene, substantially of the formula

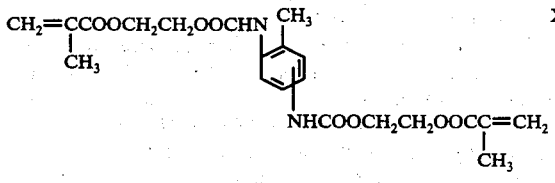

XXI

PRODUCT K

To a stirred mixture of Product A (166 g) and toluene (300 g) at 65° was added methacrylyl chloride (16 g, i.e. 0.2 equiv., calculated on the hydroxyl content of Product A) dropwise over 30 minutes. The mixture was then stirred at 80° for 2 hours, and the solvent was removed under reduced pressure. Product K comprises a mixture of 1,4-bis(2-hydroxy-3-methacrylyloxypropoxy)butane, i.e., residual Product A, 1-(2,3-bis(methacrylyloxy)-propoxy)-4-(2-hydroxy-3-methacrylyloxypropoxy)butane, and 1,4-bis(2,3-bis(methacrylyloxy)propoxy)butane.

ACCELERATOR A

Triethylenetetramine (146 g), isobutyl methyl ketone (500 g), and benzene (300 g) were heated under reflux, collecting the water formed in a Dean and Stark trap. After all the water had been collected (36 ml), the benzene and the excess of isobutyl methyl ketone were removed under reduced pressure. The product was distilled under a reduced pressure of 0.4 mm Hg.

ACCELERATOR B

Ethylenediamine (60 g), isobutyl methyl ketone (220 g), and benzene (150 g) were heated under reflux, collecting the water formed in a Dean and Stark trap. After 5 hours 36 ml of water had been collected. The benzene and the excess of the ketone were removed under reduced pressure and the product was distilled, b.pt. 76°/0.2 mm.

ACCELERATOR C

Triethylenetetramine (146 g), acetone (120 g), and benzene (200 g) were stirred at 60° for 2 hours. The mixture was then heated under reflux, collecting the water formed in a Dean and Stark trap (24 ml was collected). The benzene and the excess of the ketone were removed under reduced pressure and the product was distilled, boiling at 98°–110°/0.2 mm. It crystallised on cooling.

ACCELERATOR D

Triethylenetetramine (100 g), ethyl methyl ketone (150 g), and benzene (250 g) were heated under reflux, collecting the water produced in a Dean and Stark trap (28 ml was collected). The benzene and the excess of the ketone were removed under reduced pressure.

ACCELERATOR E

This is a nondistilled quality of Accelerator A.

ACCELERATOR F

A mixture of n-butyraldehyde (80 g), triethylenetetramine (73 g), and benzene (200 g) was heated under reflux, the water formed being collected in a Dean and Stark trap. No more water was formed after 40 minutes, by which time 19 ml water had been collected. The solvent and the excess of aldehyde were removed under reduced pressure to leave Accelerator F.

ACCELERATOR G is triethylenetetramine.

Two washed and screened foundry-quality sands were employed to make the cores, the distribution of particle size being as follows:

| retained on mesh of (mm) | I | II |
|---|---|---|
| 1 | — | — |
| 0.6 | 0.7 | 0.1 |
| 0.4 | 5.1 | 6.3 |
| 0.3 | 13.9 | 27.8 |
| 0.2 | 44.4 | 46.6 |
| 0.15 | 28.5 | 18.2 |
| 0.1 | 6.1 | 3.6 |
| 0.08 | 0.6 | 0.2 |
| 0.063 | 0.1 | 0.1 |
| 0.025 | 0.1 | 0.1 |
| passes 0.025 | 0.5 | — |
| | 100 | 100 |

Neither contained significant amounts of water.

The Binders employed were composed as follows:

| Binder | Composition | |
|---|---|---|
| I | 79.1 | Product A |
| | 4.4 | cumene hydroperoxide |
| | 2.2 | methacrylic acid |
| | 14.3 | Accelerator A |
| II | 77.1 | Product A |
| | 4.3 | cumene hydroperoxide |
| | 4.3 | methacrylic acid |
| | 14.3 | Accelerator A |
| III | 79.9 | Product A |
| | 4.4 | cumene hydroperoxide |
| | 2.2 | methacrylic acid |
| | 13.5 | Accelerator B |
| IV | 66 | Product A |
| | 13.2 | Product B |
| | 4.4 | cumene hydroperoxide |
| | 2.2 | methacrylic acid |
| | 14.2 | Accelerator A |
| V | 87.8 | Product A |
| | 4.9 | cumene hydroperoxide |
| | 2.4 | methacrylic acid |
| | 4.9 | Accelerator G |
| VI | 73.2 | Product A |
| | 14.6 | Product B |
| | 4.9 | cumene hydroperoxide |
| | 2.4 | methacrylic acid |
| | 4.9 | Accelerator G |
| VII | 66 | Product A |
| | 13.2 | Product B |
| | 4.4 | cumene hydroperoxide |
| | 2.2 | methacrylic acid |
| | 14.2 | Accelerator C |
| VIII | 66 | Product A |
| | 13.2 | Product B |
| | 4.4 | cumene hydroperoxide |

-continued

| Binder | Composition | |
|---|---|---|
| | 2.2 | methacrylic acid |
| | 14.2 | Accelerator B |
| IX | 66 | Product A |
| | 13.2 | Product B |
| | 4.4 | cumene hydroperoxide |
| | 2.2 | methacrylic acid |
| | 14.2 | Accelerator D |
| X | 79.1 | Product C |
| | 4.4 | cumene hydroperoxide |
| | 2.2 | methacrylic acid |
| | 14.3 | Accelerator A |
| XI | 66 | Product C |
| | 13.2 | Product B |
| | 4.4 | cumene hydroperoxide |
| | 2.2 | methacrylic acid |
| | 14.2 | Accelerator A |
| XII | 57.8 | Product A |
| | 11.5 | Product B |
| | 3.8 | cumene hydroperoxide |
| | 1.9 | methacrylic acid |
| | 12.5 | Accelerator A |
| | 12.5 | water |
| XIII | 66 | Product A |
| | 13.2 | Product B |
| | 4.4 | cumene hydroperoxide |
| | 2.2 | methacrylic acid |
| | 14.2 | Accelerator E |
| XIV | 79.1 | Product D |
| | 4.4 | cumene hydroperoxide |
| | 2.2 | methacrylic acid |
| | 14.3 | Accelerator A |
| XV | 69.9 | Product A |
| | 14.0 | Product B |
| | 4.7 | cumene hydroperoxide |
| | 2.3 | methacrylic acid |
| | 9.1 | Accelerator A |
| XVI | 66 | Product A |
| | 13.2 | Product B |
| | 4.4 | cumene hydroperoxide |
| | 2.2 | methacrylic acid |
| | 14.2 | Accelerator F |
| XVII | 69.3 | Product A |
| | 13.8 | Product B |
| | 0.3 | bis(4-(N,N-diethylamino)benzene-diazonium) tetrachlorozincate |
| | 2.3 | methacrylic acid |
| | 14.3 | Accelerator E. |

The sand (150 g) was mixed with the other components of the binder except the accelerator; the latter was then added and mixed vigorously for a few seconds. (Similar results could be obtained by mixing one half of the sand with the other components of the binder except the accelerator, the other half of the sand with the accelerator, and then mixing the two pre-coated sands.) In the case of Binder XII, however, the water was added after the other components (excluding the accelerator) had been mixed in.

The compositions were then used within a few minutes of mixing to produce a standard AFS (American Foundrymen's Society) compression test piece 5 cm × 5 cm. Cure was initiated by blowing nitrogen or carbon dioxide through the core for the time indicated. Where stated, the gas was blown through water prior to passing through the core. The test piece was crushed immediately after removal from the core box.

All the compositions contained 2.3% of binder.

EXAMPLE I

First, for purposes of comparison, "dry" nitrogen, which means in this and the succeeding Examples nitrogen from a gas cylinder as received from a commerical supplier and containing less than one part per million by weight of water, was passed under a pressure of 18 $kN/m^2$ into cores made with Binder I and Sand I at 24° for various periods up to 1 minute. Other cores made with similar binders were treated in a like manner. Table I shows the results obtained.

TABLE I

| Binder | Nitrogen passed for (sec.) | Compression strength (kN/m²) |
|---|---|---|
| I | 10 | 253 |
| | 20 | 356 |
| | 30 | — |
| | 60 | 1320 |
| II | 10 | — |
| | 20 | — |
| | 30 | — |
| | 60 | 1518 |
| III | 10 | 293 |
| | 20 | — |
| | 30 | — |
| | 60 | 1298 |
| IV | 10 | 374 |
| | 20 | — |
| | 30 | 880 |
| | 60 | 1540 |
| V | 10 | 281 |
| | 20 | — |
| | 30 | 659 |
| | 60 | — |
| VI | 10 | 664 |
| | 20 | 961 |
| | 30 | 1036 |
| | 60 | 1634 |

A dash (—) indicates that the particular test was not carried out.

The results show that when Binders I and III are used the cores assume compression strengths at approximately similar rates, also that with Binders II and IV which, like Binder III, are similar in composition to Binder I, the compression strength after 1 minute is comparable with that achieved using Binder I or III.

Next, in accordance with the invention, nitrogen from the same source but moistened by passage through water in a wash-bottle at 24° was passed at the same pressure (18 kN/m²) through similar sand cores for various periods. By passing the nitrogen through a flow meter and measuring the decrease in weight of the water in the wash-bottle during passing of the nitrogen, it was shown that the moistened gas contained on average 17.3 grams of water per cubic meter, i.e., 14,700 parts per million by weight, and so is about 77% saturated. The results obtained as shown in Table II.

TABLE II

| Binder | Nitrogen passed for (sec.) | Compression strength (kN/m²) |
|---|---|---|
| I | 10 | 405 |
| | 20 | — |
| | 30 | 830 |
| | 60 | 1350 |
| IV | 10 | 785 |
| | 20 | — |
| | 30 | 2006 |
| | 60 | 3227 |
| V | 10 | 900 |
| | 20 | — |
| | 30 | 2200 |
| | 60 | 3300 |
| VI | 10 | 870 |
| | 20 | 1760 |
| | 30 | — |
| | 60 | — |
| VII | 10 | 968 |
| | 20 | — |
| | 30 | 1687 |
| | 60 | 1980 |
| VIII | 10 | 275 |
| | 20 | — |
| | 30 | 979 |
| | 60 | 1397 |
| IX | 10 | 814 |
| | 20 | — |
| | 30 | 2464 |
| | 60 | 2970 |
| X | 10 | 770 |
| | 20 | — |
| | 30 | 1023 |
| | 60 | 1210 |
| XI | 10 | 1050 |

TABLE II-continued

| Binder | Nitrogen passed for (sec.) | Compression strength (kN/m²) |
|---|---|---|
| | 20 | — |
| | 30 | 1540 |
| | 60 | 2970 |

Comparison of the results obtained using Binders I, V, and VI with those presented in Table I for those Binders show the more rapid assumption of compression strength when moist nitrogen is used. The results for Binder IV in Table II demonstrate the rapid gain in compression strength of level at 1 minute considerably higher than those achieved with dry nitrogen.

EXAMPLE II

In another experiment, dry nitrogen was passed through cores made with Binder XII, i.e., a Binder similar to Binder IV but containing water.

The compression strengths achieved after nitrogen had been passed, for 10, 30, and 60 seconds were 572, 1122, and 1870 kN/m²: the comparable values with Binder IV using dry nitrogen and dry components were, as shown in Table I, 374, 880, and 1540 kN/m². Table II shows, however, that by incorporation the water by means of moist nitrogen, still higher strengths can be achieved with Binder IV.

EXAMPLE III

In this experiment the procedure described in the second part of Example I, i.e., using "moist" nitrogen, was repeated, but the cores were made with Sand II. Table III shows the results obtained.

TABLE III

| Binder | Nitrogen passed for (sec.) | Compression strength (kN/m²) |
|---|---|---|
| I | 10 | 330 |
| | 30 | 660 |
| | 60 | 2200 |
| IV | 10 | 638 |
| | 30 | 1958 |
| | 60 | 3520 |
| XIII | 10 | 660 |
| | 30 | — |
| | 60 | — |
| XIV | 10 | 210 |
| | 30 | 1800 |
| | 60 | 3200 |

EXAMPLE IV

The process described in the second half of Example I was repeated except that the nitrogen gas was passed through water which was at 38°. Table IV shows the increase in compression strength of the cores on continuing passage of the gas.

TABLE IV

| Binder | Nitrogen passed for (sec.) | Compression strength (kN/m²) |
|---|---|---|
| IV | 10 | 530 |
| | 20 | 836 |
| | 30 | 1980 |
| | 60 | 3300 |
| | 120 | 3740 |
| XV | 10 | 902 |
| | 20 | — |
| | 30 | 1430 |
| | 60 | 2440 |
| | 120 | — |

EXAMPLE V

In this Example, the air was displaced by means of carbon dioxide gas at 18 kN/m² which had been passed through water at 24°. Table V shows the results obtained.

TABLE V

| Binder | Carbon dioxide passed for (sec.) | Compression strength (kN/m²) |
|---|---|---|
| IV | 180 | 330 |
| | 300 | 750 |
| X | 300 | 132 |

EXAMPLE VI

In this Example, Binder XVI, which contains Accelerator F, made from an aldehyde, was used. On passing moist nitrogen at 24° for 30 and 120 seconds, the compression strengths of the cores were 440 and 1100 kN/m². For purposes of comparison, dry nitrogen was used in the case of some samples. and their compression strength after 120 seconds was only 220 kN/m².

EXAMPLE VII

The procedure described in the second half of Example 1 was repeated, using Binder XVII, which contains a diazonium salt as the latent initiator, the moist nitrogen being at 20°. After the nitrogen had been passed for 30 and 60 seconds, the compression strengths of the cores were 312 and 836 kN/m².

EXAMPLE VIII

The following Binders are further examples of compositions suitable for carrying out the method of this invention as described in Example III, used at a level of 2% by weight of the sand.

| Binder | Composition |
|---|---|
| XVIII | 90 Product E |
| | 5 cumene hydroperoxide |
| | 2.5 methacrylic acid |
| | 5 Accelerator G |
| XIX | 90 Product F |
| | 5 cumene hydroperoxide |
| | 5 Accelerator G |
| XX | 90 Product G |
| | 5 cumene hydroperoxide |
| | 5 Accelerator G |
| XXI | 90 Product H |
| | 5 cumene hydroperoxide |
| | 5 Accelerator G |
| XXII | 90 Product I |
| | 5 cumene hydroperoxide |
| | 5 Accelerator G |
| XXIII | 45 Product I |
| | 45 Product J |
| | 5 cumene hydroperoxide |
| | 5 Accelerator G |
| XXIV | 67.5 Product A |
| | 22.5 Product J |
| | 5 cumene hydroperoxide |
| | 5 Accelerator G |
| XXV | 90 Product K |
| | 5 cumene hydroperoxide |
| | 5 methacrylic acid |
| | 5 Accelerator G |

I claim:

1. A method of making a shaped article from particulate solid material which comprises
   i. forming a mixture of the particles and an anaerobically-curing adhesive containing, as a curing accelerator, either an aliphatic amine having at least two primary aliphatic amino groups or a condensation product of such an amine with a ketone or with an aldehyde,
   ii. forming the mixture into the desired shape, and
   iii. in the presence of water, causing the adhesive to cure and to bond the particles together by displacing air or other oxygen-containing gas in the environment of the shaped article with an inert gas or vapour.

2. The method of claim 1, in which the inert gas is nitrogen, a rare gas, or carbon dioxide.

3. The method of claim 1, in which there is used as most 0.5% by weight of water, calculated on the combined weight of the adhesive and the particles.

4. The method of claim 1, in which the inert gas or vapour is at a temperature of from 15° to 35° C.

5. The method of claim 1, in which the water present is imparted to the mixture of the particles and the adhesive by first passing the inert gas or vapour through water.

6. The method of claim 5, in which the inert gas or vapour contains from 5 to 40 grams of water vapour per cubic meter after passage through the water.

7. The method of claim 1, in which there is used from 0.5 to 10% by weight of the anerobically-curing adhesive, calculated on the weight of the particles.

8. The method of claim 1, in which the anerobically-curing adhesive comprises, in addition to the said curing accelerator,
   a. an ester of an acrylic acid and
   b. a latent initiator of free-radical polymerisation.

9. The method of claim 8, in which there is used from 0.01 to 15% by weight of (b), calculated on the weight of the ester (a).

10. The method of claim 8, in which there is used from 1 to 10% by weight of the said curing accelerator, calculated on the weight of the ester (a).

11. The method of claim 8, in which the ester (a) is of the general formula

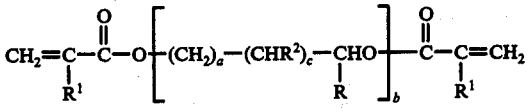

where $a$ is an integer of 1 to 8,
$b$ is an integer of 1 to 20,
$c$ is zero or 1,
R denotes —H, —$CH_3$, —$C_2H_5$, —$CH_2OH$, or

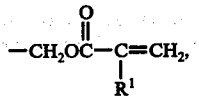

each $R^1$ denotes —H, —Cl, —$CH_3$, or —$C_2H_5$, and $R^2$ denotes —H, —OH, or

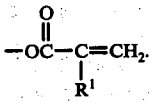

12. The method of claim 8, in which the ester (a) is of the general formula

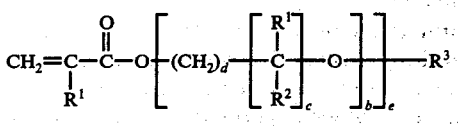

where $b$ is an integer of 1 to 20, $c$ is 0 or 1, $d$ is 0 or a positive integer, provided that $c$ and $d$ are not both zero, $e$ is 1, 2, 3, or 4, each $R^1$ denotes —H, —Cl, —$CH_3$, or —$C_2H_5$, $R^2$ denotes —H, —OH, or

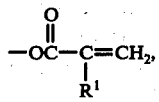

and $R^3$ denotes an organic radical of valency, $e$, linked through a carbon atom or carbon atoms thereof to the indicated $e$ terminal oxygen atoms.

13. The method of claim 8, in which the ester (a) is of the general formula

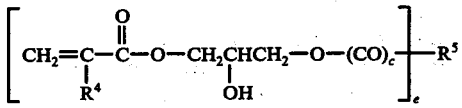

where $c$ is zero or 1, $e$ is 1, 2, 3, or 4, $R^4$ denotes —H or —$CH_3$, and $R^5$ denotes an organic radical of valency $e$, linked through a carbon atom other than the carbon atom of a carbonyl group.

14. The method of claim 8, in which the ester ($a$) is of the general formula

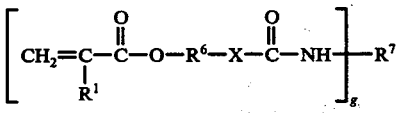

where $R^1$ denotes —H, —Cl, —$CH_3$, or —$C_2H_5$, $R^6$ denotes a divalent aliphatic, cycloaliphatic, aromatic, or araliphatic group, bound through $a$ carbon atom or carbon atoms thereof to the indicated —O— atom and —X— atom or group, X denotes —O—or

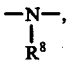

where $R^8$ stands for —H or an alkyl radical of from 1 to 8 carbon atoms, $g$ is an integer of at least 2 and at most 6, and $R^7$ denotes a $g$-valent aliphatic, cycloaliphatic, aromatic, or araliphatic group, bound through a carbon atom or carbon atoms thereof to the indicated —NH—groups.

15. The method of claim 8, in which the ester (a) is of the general formula

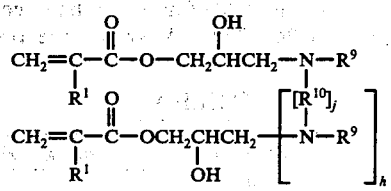

where each $R^1$ denotes —H, —Cl, —$CH_3$, or —$C_2H_5$, each $R^9$ denotes —H, an alkyl radical of 1 to 6 carbon atoms, a cyano-alkyl radical of 2 to 7 carbon atoms, a hydroxyalkyl radical of 1 to 6 carbon atoms, or an alkyl group of 1 to 6 carbon atoms substituted by a group of formula

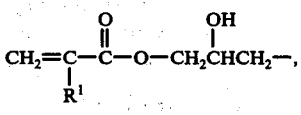

each $R^{10}$ is a divalent aliphatic, aromatic, heterocyclic, or cycloaliphatic residue of 1 to 10 carbon atoms, linking through carbon atoms thereof the indicated nitrogen atoms, $j$ is 0 or 1, and $h$ is 0 or an integer of from 1 to 4, with the proviso than when $j$ represents zero, $h$ represents 1.

16. The method of claim 8, in which the ester ($a$) is of the general formula

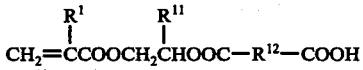

where $R^1$ denotes —H, —Cl, —$CH_3$, or —$C_2H_5$, $R^{11}$ denotes —H, —$CH_3$, or —$CH_2Cl$, and $R^{12}$ denotes the residue of an at least dicarboxylic acid after removal of two carboxyl groups, linked through one carbon atom to the indicated group

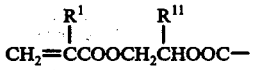

and by an adjacent carbon atom to the indicated -COOH group.

17. The method of claim 8, in which the ester ($a$) is of the general formula

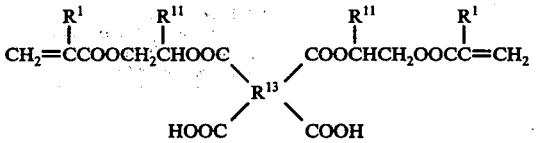

where each $R^1$ denotes —H, —Cl, —$CH_3$, or —$C_2H_5$, each $R^{11}$ denotes —H, —$CH_3$, or —$CH_2Cl$, and $R^{13}$ denotes a tetravalent group containing at least one carbocyclic ring, each indicated pair of groups $$-\underset{\underset{R^{11}}{|}}{COOCH}CH_2OOC\underset{\underset{R^{1}}{|}}{C}=CH_2$$

and —COOH being directly linked to adjacent carbon atoms.

18. The method of claim 8, in which the ester (a) is of the formula $$R^{15}C\left(CH_2OOC\overset{\overset{R^{1}}{|}}{C}=CH_2\right)_3$$

where $R^1$ denotes —H, —Cl, —$CH_3$, or —$C_2H_5$ and $R^{15}$ denotes —$CH_3$, —$C_2H_5$, or $$-CH_2OOC\underset{\underset{R^{1}}{|}}{C}=CH_2.$$

19. The method of claim 1, in which the latent initiator is a diazonium salt.

20. The method of claim 1, in which the latent initiator is redox-activatable.

21. The method of claim 20, in which the initiator is a hydroperoxide or a peroxide.

22. The method of claim 1, in which the accelerator is of the formula $$H_2N(CH_2\overset{\overset{R^{4}}{|}}{C}HNH)_kH$$

where $R^4$ denotes —H or —$CH_3$ and $k$ is an integer of from 1 to 4.

23. The method of claim 1, in which the accelerator is such a condensation product, free from primary amino groups.

24. The method of claim 1, in which the condensation product used as the accelerator is of an aliphatic ketone of 3 to 10 carbon atoms or of an aliphatic aldehyde of 2 to 6 carbon atoms.

25. The method of claim 1, in which the amine, the condensation product of which is used, is of the formula $$H_2N(CH_2\overset{\overset{R^{4}}{|}}{C}HNH)_kH$$

$$H_2N(CH_2\overset{\overset{R^{4}}{|}}{C}HNH)_kH$$

where $R^4$ denotes —H or —$CH_3$ and $k$ is an integer of from 1 to 4.

* * * * *